US005207419A

United States Patent [19]

Schroeder

[11] Patent Number: 5,207,419

[45] Date of Patent: May 4, 1993

[54] DIRECT MOUNT FOR BASKETBALL BACKBOARD AND RIM

[76] Inventor: Edward A. Schroeder, 630 Oceola Dr., Algonquin, Ill. 60102

[21] Appl. No.: 552,466

[22] Filed: Jul. 16, 1990

[51] Int. Cl.[5] ..... A63B 63/08

[52] U.S. Cl. ..... 273/1.5 R

[58] Field of Search ..... 273/1.5 R, 1.5 A, 55 B, 273/55 R, 55 A; 403/408.1, 387, 388, 12; 272/73; 280/293

[56] References Cited

U.S. PATENT DOCUMENTS

| | | | |
|---|---|---|---|
| 2,623,557 | 12/1952 | Kendall | 403/388 |
| 3,964,743 | 6/1976 | Salsich, Sr. | 273/1.5 R |
| 3,986,318 | 10/1976 | McConnell | 403/408.1 |
| 4,035,093 | 7/1977 | Redshaw | 403/388 |
| 4,240,762 | 12/1980 | Lobanoff | 403/337 |
| 4,377,283 | 3/1983 | Mahoney . | |
| 4,395,040 | 7/1983 | White | 273/1.5 R |
| 4,433,839 | 2/1984 | Simonseth . | |
| 4,588,188 | 5/1986 | Mahoney et al. . | |
| 4,846,469 | 7/1989 | Nye . | |
| 4,895,365 | 1/1990 | Schroeder | 273/1.5 R |
| 4,953,893 | 9/1990 | Hsiao | 280/293 |

FOREIGN PATENT DOCUMENTS

| | | | |
|---|---|---|---|
| 33113 | 3/1885 | Fed. Rep. of Germany | 403/388 |

*Primary Examiner*—Theatrice Brown

[57] ABSTRACT

A mounting system for a direct mount basketball backboard and rim assembly that allows for independent adjustment and retention for independent adjustment and retention of the backboard to a support of the direct mount without the mounting of the basketball rim.

8 Claims, 1 Drawing Sheet

DIRECT MOUNT FOR BASKETBALL BACKBOARD AND RIM

BACKGROUND AND SUMMARY OF THE INVENTION

The invention relates to a direct mount mounting system wherein the basketball rim is mounted directly through the backboard to the backboard support. These systems are designed to transfer loads on the rim to the support instead of the backboard.

In the past basketball backboards and rims were connected to direct mounts via an elongated bolt which extended through a mounting plate from a support post and corresponding holes in a basketball backboard and rim supporting plate. For assembly, the bolts were extended through bolt openings in the direct mount supporting plate and the basketball backboard was then lifted up and corresponding holes in it aligned with the bolts. A basketball rim mounting plate then had its holes aligned with the bolts and slid on thereto. Bolt nuts were then attached to the bolts and tightened. This produced a sandwich structure of support plate, backboard and rim. FIG. 3 of U.S. Pat. No. 3,964,743 to Salsich, issued Jun. 22, 1976 shows such a mounting.

The above mounting system has disadvantages since it requires that the rim and backboard be adjusted as a unit to the mounting post plate. This is quite cumbersome. In addition, loosening of the bolts to replace the rim or to store the rim (e.g. for the winter season on outside basketball arrangements) loosened the adjustment of the backboard and mounting plate and this requires readjustment when remounting. Additionally one had to be careful that the backboard didn't slip off while the rim was being removed.

Alternatively, it is known to fixedly and adjustably mount the backboard to the mount through one set of bolts and to mount the rim to the backboard through a separate set of bolts. FIG. 4 of U.S. Pat. No. 4,815,365 to Schroeder, issued Jan. 23, 1990 shows such a mounting system.

This system has the disadvantage of mandating a plurality of holes and bolts for the mounting function.

It is an object of this invention to provide a direct mount basketball board and rim assembly that avoids the above identified disadvantages.

The instant invention contemplates mounting the backboard and rim to a plate of a direct mount system through a single set of bolts wherein the backboard can be fixedly adjusted to the plate without the rim and wherein the rim is easily detachable without affecting the alignment of the backboard.

Other objects, advantages and novel features of the present invention will become apparent from the following detailed description of the invention when considered in conjunction with the accompanying drawings.

DETAILED DESCRIPTION OF THE DRAWINGS

Figure 1:
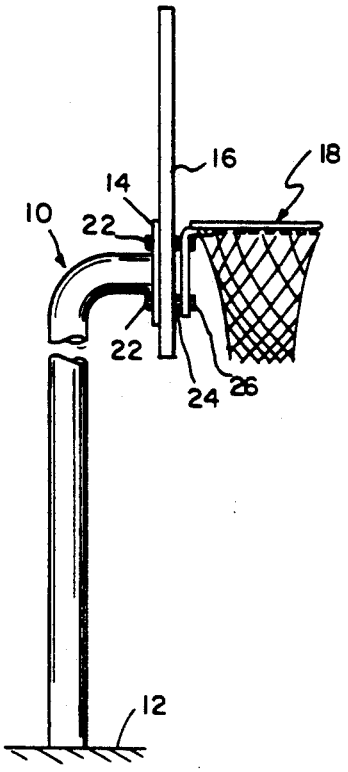
FIG. 1 shows schematically a direct mount for a basketball backboard and rim utilizing the invention.
Figure 2:
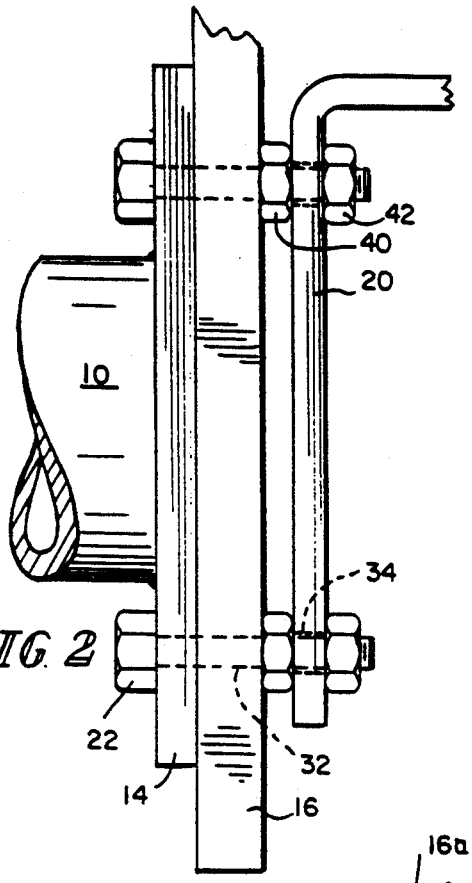
FIG. 2 shows an enlarged side view of the mounting system of FIG. 1.
Figure 3:
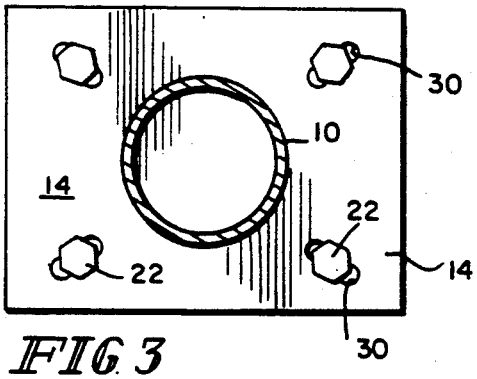
FIG. 3 shows a front view of adjustable mounting slots in the support plate of the direct mount.
Figure 5:
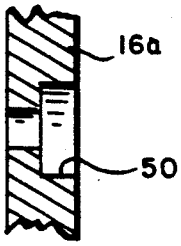
FIG. 5 shows an enlargement of a cross-section of the hole in the backboard utilized in the structure of FIG. 4.

FIG. 1 shows a direct mount basketball backboard and rim support system wherein a post 10 is imbedded into the ground 12 and has a mounting plate 14 secured thereto such as by welding. Also shown is a basketball backboard 16 and a basketball rim assembly 18 having a mounting plate 20. Bolts 22 extend through elongated holes 30 in the mounting plate 14, aligned holes 32 in the basketball backboard 16, and holes 34 in the basketball rim 18 mounting plate 22, as shown in detail in FIG. 2. Nuts 40 on the bolts 22 hold the basketball backboard 16 against the support plate 14. Since the holes 30 in the support plate 14 are elongated and slanted as illustrated in FIG. 3, the backboard can be angular and height adjusted with respect to the support plate 14 and then nuts 40 tightened to hold the basketball backboard in position. The rim plate 20 can then be slid on to the ends of the bolts 22 and bolted thereto by nuts 42.

In this manner the basketball backboard 16, without the rim 18, can be fixedly mounted and adjusted by itself. The rim 18 can be removed without affecting the orientation or mounting of the backboard 16.

Figure 4:
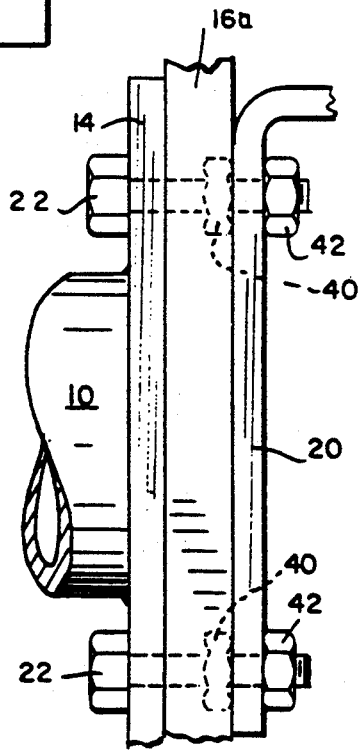
FIG. 4 shows an alternative structure corresponding to FIG. 2 wherein nuts are recessed into the basketball backboard.

FIG. 4 shows as modification of the basketball backboard **16*a*. Here the holes 32 in the basketball backboard 16*a* have enlarged openings 50 or counterbores to house the nuts 40 therein. This allows the mounting plate 20** of the basketball rim to lie flush on the face of the backboard. These types of backboards are normally molded with reinforcement ridges where the bolt holes are. See the patent to Salsich, supra for such a molded structure.

Thus it can be seen that by utilizing elongated bolts 22 with double nuts 40, 42, one can obtain a secure backboard adjustment to a direct mount without mounting the basketball rim. At the same time this allows for mounting and removal of the rim without changing the backboard alignment.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A combined basketball backboard and rim direct mounting system comprising:

a basketball backboard;

a support means for mounting the basketball backboard and rim to a fixed structure and including a flat member attached to said fixed structure;

aligned sets of mounting holes in said flat member, basketball backboard and rim;

screw and nut means for each of said sets of holes for adjustably mounting the basketball backboard to the flat member in a fixed proper orientation with respect to the flat member; and securement means cooperating with an extension on each of said screw means to subsequently and independently mount said basketball rim to said flat member while maintaining the said proper orientation of said backboard member.

2. The mounting system of claim 1 wherein the flat member mounting holes are elongated and slanting to provide for adjustment of the backboard with respect to the flat member.

3. The mounting system of claim 2 wherein the nut means are located in enlarged hole areas within the backboard, so that the rim can fit flush against the backboard.

4. The mounting system of claim 1 wherein the nut means are located in enlarged hole areas within the blackboard, so that the rim can fit flush against the backboard.

5. A system for direct mounting a basketball backboard and rim to a support means fixed to a structure and including a flat member comprising:

a basketball backboard;

aligned sets of mounting holes in said flat member, basketball backboard and rim;

screw and nut means for each of said sets of holes for adjustably mounting the basketball backboard to the flat member in a fixed proper orientation with respect to the flat member; and securement means cooperating with an extension on each of said screw means to subsequently and independently mount said basketball rim to said flat member while maintaining the said proper orientation of said backboard member.

6. The mounting system of claim 5 wherein the flat member mounting holes are elongated and slanted to provide for adjustment of the backboard with respect to the flat member.

7. The mounting system of claim 6 wherein the nut means are located in enlarged hole areas within the backboard, so that the rim can fit flush against the backboard.

8. The mounting system of claim 5 wherein the nut means are located in enlarged hole areas within the backboard, so that the rim can fit flush against the backboard.

* * * * *